United States Patent [19]

Cook, Jr.

[11] 3,956,083

[45] May 11, 1976

[54] ELECTROCHEMICAL ANODE AND PROCESS USING THE ANODE

[75] Inventor: Edward H. Cook, Jr., Lewiston, N.Y.

[73] Assignee: Hooker Chemicals & Plastics Corporation, Niagara Falls, N.Y.

[22] Filed: May 5, 1975

[21] Appl. No.: 574,806

Related U.S. Application Data

[62] Continuation-in-part of Ser. No. 494,110, Aug. 2, 1974, Pat. No. 3,882,002.

[52] U.S. Cl. ..... 204/95; 204/98; 204/128; 204/290 F

[51] Int. Cl.[2] ..... C25B 1/26; C25B 1/16; C25B 11/10

[58] Field of Search ..... 204/290 F, 128, 98, 204/95

[56] References Cited

UNITED STATES PATENTS

| | | | |
|---|---|---|---|
| 3,801,490 | 4/1974 | Welch | 204/290 F |
| 3,810,770 | 5/1974 | Bianchi et al. | 204/290 F |
| 3,865,703 | 2/1975 | Schenker et al. | 204/290 F |
| 3,882,002 | 5/1975 | Cook | 204/128 |

*Primary Examiner*—R. L. Andrews
*Attorney, Agent, or Firm*—Peter F. Casella; Herbert W. Mylius

[57] ABSTRACT

An electrode for use in electrolytic processes, comprises a valve metal substrate, a coating thereon of conductive tin oxide containing a doping amount of tellurium, preferably up to about 0.3 mole percent of tellurium, based on moles of tin, and an outer coating of a noble metal or noble metal oxide.

9 Claims, No Drawings

ELECTROCHEMICAL ANODE AND PROCESS USING THE ANODE

CROSS-REFERENCE TO RELATED APPLICATIONS

This application is a continuation-in-part application of U.S. patent application Ser. No. 494,110, filed Aug. 2, 1974, now U.S. Pat. No. 3,882,002.

BACKGROUND OF THE INVENTION

The present invention relates to improved electrodes particularly adapted for use as anodes in electrochemical processes involving the electrolysis of brines.

A variety of materials have been tested and used as anodes in electrolytic cells. In the past, the material most commonly used for this purpose has been graphite. However, the problems associated with the use of graphite anodes are several. The chlorine overvoltage of graphite is relatively high, in comparison for example with the noble metals. Furthermore, in the corrosive media of an electrochemical cell graphite wears readily, resulting in substantial loss of graphite and the ultimate expense of replacement as well as continued maintenance problems resulting from the need for frequent adjustment of spacing between the anode and cathode as the graphite wears away. The use of noble metals and noble metal oxides as anode materials provides substantial advantages over the use of graphite. The electrical conductivity of the noble metals is substantially higher and the chlorine overvoltage substantially lower than that of graphite. In addition, the dimensional stability of the noble metals and noble metal oxides represents a substantial improvement over graphite. However, the use of noble metals as a major material of construction in anodes results in an economic disadvantage due to the excessively high cost of such materials.

In attempts to avoid the use of the expensive noble metals various other anode materials have been proposed for use as coatings over valve metal substrates. In U.S. Pat. No. 3,627,669, it is disclosed that mixtures of tin dioxide and oxides of antimony can be formed as adherent coatings on a valve metal substrate to form an anode useful in electrochemical processes. In the electrolytic production of chlorine, anodes of this type provide the advantage of economy in the elimination of the use of expensive noble metals or noble metal oxides. In addition the tin oxide coating provides an effective protection for the substrate. However, the tin oxide compositions, although useful as an anode material, exhibit a chlorine overvoltage that is substantially higher than that of the noble metals or noble metal oxides. Thus, despite the elimination of expensive noble metals, the cost of chlorine production, in processes using such anodes, is relatively high.

Considerable effort has been expended in recent years in attempts to develop improved anode materials and structures utilizing the advantages of noble metals or noble metal oxides. A great amount of effort has been directed to the development of anodes having a high operative surface area of noble metal or noble metal oxide in comparison with the total quantity of the material employed. This may be done, for example, by employing the noble metal as a thin film or coating over an electrically conductive substrate. However, when it is attempted to minimize the aforementioned economic disadvantage of the noble metals by applying them in the form of very thin films over a metal substrate, it has been found that such very thin films are often porous. The result is an exposure of the substrate to the anode environment, through the pores in the outer layer. In addition, in normal use in an electrolytic cell, a small amount of wear, spalling or flaking off of portions of the noble metal or noble metal oxide is likely to occur, resulting in further exposure of the substrate. Many materials, otherwise suitable for use as a substrate are susceptible to chemical attack and rapid deterioration upon exposure to the anode environment. In an attempt to assure minimum deterioration of the substrate under such circumstances, anode manufacturers commonly utilize a valve metal such as titanium as the substrate material. Upon exposure to the anodic environment, titanium, as well as other valve metals, will form a surface layer of oxide which serves to protect the substrate from further chemical attack. The oxide thus formed, however, is not catalytically active and as a result the operative surface area of the anode is decreased.

Accordingly, it is an object of the present invention to provide improved electrodes for use as anodes in electrolytic processes. It is a further object to provide such anodes having an operative surface of noble metal or noble metal oxide and having improved efficiency and maintenance characteristics.

STATEMENT OF INVENTION

This invention provides a novel electrode, especially suited for use as an anode in chlor-alkali cells and alkali metal chlorate cells, the novel electrode comprising a valve metal substrate having a protective coating thereon of conductive tin oxide containing a doping amount of tellurium and an outer coating of a noble metal or noble metal oxide. Preferably the coating of conductive tin oxide contains up to about 0.3 mole percent of tellurium based on moles of tin. Electrodes of this type exhibit a high degree of durability in addition to the relatively low overvoltage characteristics of a noble metal or noble metal oxide, making them well-suited for use as anodes in the electrolytic production of chlorine.

Among the advantages of such construction is the protection afforded the substrate by the coating of doped tin oxide. The preferred substrate materials of the anodes of this invention are the valve metals, such as titanium, tantalum, niobium, or zirconium, especially titanium. However, where suitably thick intermediate layers of tin oxide are employed, other more conductive metals may be considered for use as substrates. The doped tin oxide coating, which may range in coating weight for example from about 0.1 grams per square meter to 100 grams per square meter or more, depending on the degree of protection desired, prevents contact of the substrate and the electrolyte, thus preventing or minimizing corrosion or surface oxidation and the attendant deterioration or passivation of the substrate. At the same time, the outer layer provides the advantageous catalytic properties of the noble metals or noble metal oxides. In addition, the protective layer of tellurium doped tin oxide permits the use of a relatively thin layer of the noble metal or noble metal oxide and a consequent savings resulting from a minimal use of a precious metal. Typically, the layer of noble metal or noble metal oxide will have a coating weight in the range of about 0.1 grams per square meter to about 20 grams per square meter or higher and preferably about 3 to 10 grams per square meter in thickness. The disadvantage of pores or pinholes in the noble metal layer common in extremely thin layers is obviated by the presence of the intermediate layer of conductive tin oxide. Pores or pinholes in the noble metal layer, or wearing away of that outer layer over long periods of use result in the gradual exposure of the tin oxide layer. The intermediate layer of tin oxide will continue to provide a catalytically active surface in those exposed areas. The catalytic characteristics of tin oxide, although not as high as the noble metals or noble metal oxides, is higher than that of the valve metal oxide. Thus, the overall deterioration of the catalytic properties of the anode is more gradual and maintenance problems are accordingly lessened.

In addition, the intermediate layer of tin oxide provides an increase in surface area of the anode with a consequent improvement in overvoltage. Furthermore, the adhesion of the noble metal or noble metal oxide to the substrate may be increased by the presence of the intermediate layer of tin oxide and the problem of spalling of the surface layer thereby reduced.

DESCRIPTION OF THE PREFERRED EMBODIMENTS

The novel electrodes of this invention may be employed in various electrochemical processes and are especially suited for use as anodes in electrolytic cells, such as chlor-alkali cells and alkali metal chlorate cells for the electrolysis of brines. The cathode of such a cell may be formed of an electrically conductive material which is resistant to attack under conditions of electrolysis. Thus, for example, a cathode of graphite, iron, steel, or other electrically conductive, resistant material may be employed. In a chlor-alkali cell, for the production of chlorine and caustic, the anode and the cathode are separated by a diaphragm, thereby minimizing the flow of liquids from the anode compartment to the cathode compartment of the cell. The diaphragm may be of the asbestos type or, preferably, of the membrane type, which is impervious to both liquids and gases and which provides a control of ionic and molecular migration during electrolysis. Suitable cation-active permselective membranes which may be employed are disclosed in copending application Ser. No. 564,529, filed Apr. 2, 1975.

In the alkali metal chlorate cells, the brine solution to be electrolyzed is preferably substantially saturated and slightly acidified. Generally, a small amount, such as 2 grams per liter, of sodium dichromate is added to the brine solution to reduce the corrosive action of hypochlorous acid which may be liberated by hydrochloric acid that may be present in the electrolysis. In such a cell the electrolysis products are allowed to mix, forming alkali metal hypochlorites which in turn are oxidized to alkali metal chlorates.

The valve metal substrate which forms the inner or base component of the anode is an electroconductive metal having sufficient mechanical strength to serve as a support for the coating and having a high degree of chemical resistivity, especially to the anodic environment of electrolytic cells. Typical valve metals include, for example, Ti, Ta, Nb, Zr, and alloys thereof. The valve metals are well known for their tendency to form an inert oxide film upon exposure to an anodic environment. The preferred valve metal, based on cost and availability as well as electrical and chemical properties is titanium. The conductivity of the substrate may be improved, if desired, by providing a central core of a highly conductive metal such as copper. In such an arrangement, the core must be electrically connected to and completely protected by the valve metal substrate.

Tin oxide can be readily formed as an adherent coating on a valve metal substrate, in a manner described hereinafter, to provide a protective, electrically conductive layer which is resistant to chemical attack in anodic environments. Pure tin oxide however has a relatively high electrical resistivity in comparison to metals and exhibits undesirable change in electrical resistivity as a function of temperature. It is well known that the electrical stability of tin oxide coatings may be substantially improved and the electrical resistivity lowered through the introduction of a minor proportion of a suitable inorganic material (commonly referred to as a "dopant"). A variety of materials, especially various metal oxides and other metal compounds and mixtures thereof, have been disclosed in the prior art as suitable dopants for stabilizing and lowering the electrical resistivity of tin oxide composition. Among the materials shown in the prior art to be useful as dopants in conductive tin oxide compositions are included, for example, fluorine compounds, especially the metal salts of fluorine, such as sodium fluoride, potassium fluoride, lithium fluoride, berylium fluoride, aluminum fluoride, lead fluoride, chromium fluoride, calcium fluoride, and other metal fluorides; hydrazine, phenylhydrazine; phosphorus compounds such as phosphorus chloride, phosphorus oxychloride, ammonium phosphate, organic phosphorus esters such as tricresyl phosphate; as well as compounds of tellurium, tungsten, antimony, molybdenum, arsenic, and others and mixtures thereof. The conductive tin oxide coatings of this invention comprise tin oxide, containing a doping amount of tellurium. The preferred tin oxide coatings of this invention comprise tin oxide containing up to about 0.3 mole percent of tellurium and most preferably about 0.001 to about 0.2 mole percent of tellurium relative to moles of tin.

Conductive tin oxide coatings may be adherently formed on the surface of the valve metal substrate by various methods known in the art. Typically, such coatings may be formed by first chemically cleaning the substrate, for example, by degreasing and etching the surface in a suitable acid, e.g., oxalic acid, then applying a solution of appropriate thermally decomposable salts, drying and heating in an oxidizing atmosphere. The salts that may be employed include, in general, various thermally decomposable inorganic or organic salts or esters of tin and tellurium including for example their chloride, nitrates, oxychloride, alkoxides, alkoxy halides, resinates, amines and the like. Typical salts include for example, stannic chloride, stannous chloride, dibutyltin dichloride, tin tetraethoxide, tellurium tetrachloride, tellurium dichloride, and the like. Suitable solvents include for example, methyl alcohol, ethyl alcohol, propyl alcohol, isopropyl alcohol, butyl alcohol, pentyl alcohol, amyl alcohol, toluene, benzene and other organic solvents as well as water.

The solution of thermally decomposable salts, containing for example, a salt of tin and a salt of tellurium in the desired proportions, may be applied to the cleaned surface of the valve metal substrate by painting, brushing, dipping, rolling, spraying vapor or deposition, or other method. The coating is then dried by heating for example at about 100° to 200° C for several minutes to evaporate the solvent, and then heating at a higher temperature, e.g., 250° to 800° C in oxidizing atmosphere to convert the tin and tellurium compounds to an oxide form. Alternatively, the solution of salts may be applied in a known manner, by spraying or vapor deposition on a preheated substrate, at a temperature such as 250° to 800° C. A process useful for the formation of films of tellurium doped tin oxide is disclosed in U.S. Pat. No. 2,692,836. The coating procedure may be repeated as many times as necessary to achieve a desired coating weight or thickness. The final coating weight of the conductive tin oxide coating may vary considerably, but is preferably in the range of about 3 to about 30 grams per square meter. Although the exact form in which the tellurium is present in the final oxide coating is not certain, it is assumed to be present as a replacement for tin in a tin dioxide lattice structure.

The outer coating of the anode comprises a noble metal or noble metal oxide such as platinum, iridium, rhodium, palladium, ruthenium or osmium or mixtures or alloys of these metals or the oxides or mixtures of the oxides of these metals. An outer coating of a noble metal may be applied by known methods such as electroplating, chemical deposition from a platinum coating solution, spraying, or other methods.

Preferably, the outer coating of the anode comprises a noble metal oxide. Noble metal oxide coatings may be applied by first depositing the noble metal in the metallic state and then oxidizing the noble metal coating, for example, by galvanic oxidation or chemical oxidation by means of an oxidant such as an oxidizing salt melt, or by heating to an elevated temperature, e.g., 300° to 600° C or higher in an oxidizing atmosphere such as air, or oxygen, at atmospheric or superatmospheric pressures to convert the noble metal coating to a coating of the corresponding noble metal oxide. Other suitable methods include, for example, electrophoretic deposition of the noble metal oxide; or application of a dispersion of the noble metal oxide in a carrier, such as alcohol, by spraying, brushing, rolling, dipping, painting or other method on to the tin oxide surface followed by heating at an elevated temperature to evaporate the carrier and sinter the oxide coating. A preferred method for the formation of the noble metal oxide coating involves coating the conductive tin oxide surface with a solution of a noble metal compound, evaporating the solvent and converting the coating of noble metal compound to the oxide by chemical or electrochemical reaction. For example, the conductive tin oxide surface may be coated with a solution of a thermally decomposable salt of a noble metal, such as a solution of a noble metal halide in an alcohol, evaporation of the solvent, followed by heating at an elevated temperature such as between about 300° and 800° C in an oxidizing atmosphere such as air or oxygen for a period of time sufficient to convert the noble metal halide to a noble metal oxide. The procedure for formation of a noble metal or noble metal oxide coating may be repeated as often as necessary to achieve the desired thickness. The foregoing and other methods for the preparation of coatings of noble metals and noble metal oxides on the surface of anodes for use in electrolytic cells are well known in the art and may be found for example in U.S. Pat. No. 3,711,385.

The following specific examples will serve to further illustrate this invention. In the examples and elsewhere in this specification and claims, all temperatures are in degrees Celsius and all parts are by weight unless otherwise indicated.

EXAMPLE 1

A strip of titanium plate is prepared by immersion in hot oxalic acid for several hours to etch the surface, then washed and dried. A coating of tellurium doped tin oxide is applied to the surface of the titanium plate in the following manner:

To a solution of about 22 parts of stannic chloride in 71 parts of isopropyl alcohol is added 0.010 parts of tellurium tetrachloride. The titanium plate is heated to a temperature of about 650° C and the solution sprayed on to the surface. The process may be repeated if desired to increase the coating thickness.

The conductive tin oxide coated titanium is further coated in the following manner:

A solution of 1 gram of ruthenium trichloride in 0.4 cubic centimeters of 36% hydrochloric acid and 6.2 cubic centimeters of butyl alcohol is brushed several times on to the tin oxide surface and then allowed to dry in air at room temperature. After drying, the samples are heated in air at 650° C for 25 minutes to decompose the ruthenium trichloride and form ruthenium dioxide. An additional coating of ruthenium trichloride is similarily applied, dried and thermally treated.

In the anode prepared in accordance with the foregoing example, the protective intermediate coating of conductive tin oxide consists of tin oxide with a minor amount of tellurium. An anode may also be prepared in accordance with this invention, following the procedure of Example 1, except that a minor amount of a fluoride, such as manganese difluoride or ammonium fluoride may be incorporated in the coating composition prior to coating in an amount of about 0.1 to about 5 mole percent based on the moles of tin compound to further enhance the conductivity and catalytic activity of the coating.

EXAMPLE 2

An anode prepared in accordance with Example 1 is employed as an anode in a chlorine cell having a steel cathode separated from the anode by a cation-active permselective membrane. Preheated brine having a composition of about 310 grams of sodium chloride per liter is supplied to the anolyte compartment wherein electrolysis is conducted at an applied anode current density of about 310 ma/cm$^2$ (2.0 ASI), and a cell temperature of about 70° to 95°C. Chlorine is produced at the anode and sodium hydroxide is produced in the cathode compartment.

EXAMPLE 3

Anode plates prepared in accordance with Example 1 are installed in a chlorate cell which employs two anode plates surrounded by a mild steel cathode shell. The gap between the anode and cathode is about 0.125 inches. The cell is operated at a current density of 4.0 ASI and maintained at a temperature of about 70°C. The electrolyzed product ranges from about 400 to 550 grams of $NaC\mathbf{10}_3$ and about 120 to 150 grams of $NaC\mathbf{1}$ and about 1.0 to 1.5 grams of sodium dichromate per liter, with a pH of about 6.7.

What is claimed is:

1. An anode for use in electrolytic processes comprising a valve metal substrate, a coating thereon of conductive tin oxide containing a doping amount of tellurium and an outer coating of at least one of a noble metal or noble metal oxide.

2. An anode according to claim 1 wherein the tellurium is present in the tin oxide in an amount of up to about 0.3 mole percent, based on the moles of tin.

3. An anode according to claim 2 wherein the substrate is titanium.

4. An anode according to claim 3 wherein the outer coating is a noble metal oxide.

5. An anode according to claim 4 wherein the outer coating is ruthenium oxide.

6. An anode according to claim 5 wherein the tellurium is present in the tin oxide in an amount of about 0.001 to about 0.2 mole percent of tellurium, based on moles of tin.

7. In a method of electrolyzing aqueous alkali metal chloride solutions in an electrolytic cell comprising an anode and a cathode wherein chlorine and an alkali metal hydroxide are formed, the improvement which comprises using as the anode, a composite structure comprising a valve metal substrate, a coating thereon of conductive tin oxide containing a doping amount of tellurium and an outer coating on the surface of the conductive tin oxide, of at least one of a noble metal or noble metal oxide.

8. A method according to claim 7 wherein the anode comprises a titanium substrate, a coating thereon of conductive tin oxide containing up to about 0.3 mole percent of tellurium based on moles of tin and an outer coating on the surface of the conductive tin oxide, of ruthenium oxide.

9. A method according to claim 8 wherein the electrolysis products are mixed to form alkali metal chlorates.

* * * * *